US005690559A

United States Patent [19]

Julius

[11] Patent Number: 5,690,559

[45] Date of Patent: Nov. 25, 1997

[54] COMBINATION GOLF CLUB COVER AND RAKE

[76] Inventor: Gloria R. Julius, 6382 18th St. NE., Saint Petersburg, Fla. 33702

[21] Appl. No.: 669,044

[22] Filed: Jun. 24, 1996

[51] Int. Cl.[6] ..... A63B 57/00

[52] U.S. Cl. ..... 473/286; 473/408; 56/400.04

[58] Field of Search ..... 473/286, 408, 473/282, 131; 294/19.1, 19.2; 56/400.01, 400.04; 172/371, 378; 206/315.2, 315.4; 150/159, 160

[56] References Cited

U.S. PATENT DOCUMENTS

| | | | |
|---|---|---|---|
| 3,210,111 | 10/1965 | Fallon | 473/286 |
| 3,478,799 | 11/1969 | Hoyt, Jr. | 150/160 |
| 3,749,407 | 7/1973 | Prochnow | 473/286 |
| 3,997,169 | 12/1976 | Bergstrom | 473/286 |
| 4,216,831 | 8/1980 | Ritchie | 56/400.04 |
| 4,871,029 | 10/1989 | Rosin | 473/286 |
| 4,971,126 | 11/1990 | Borenstein | 150/160 |
| 5,050,655 | 9/1991 | Borenstein | 150/160 |

*Primary Examiner*—Steven B. Wong
*Attorney, Agent, or Firm*—David Kiewit

[57] ABSTRACT

A sand-rake comprises a rake head portion attached to a golf club head cover that has a golf club inserted into it. This arrangement allows a golfer to dress the surface of sand in a sand trap by holding the shaft of the club and raking the sand with the teeth of the rake head to yield a desired ridged sand surface. The head, or face, cover portion is made from a resilient plastic material and has a pocket-like shape with an aperture allowing insertion or removal of the club head. A rake head portion having teeth substantially wider than a groove in the face of the golf club, may be integrally formed with, or otherwise attached to the cover. In one embodiment, the rake teeth are individually attached to the head cover in order to adapt the sand-rake to local conditions.

2 Claims, 4 Drawing Sheets

COMBINATION GOLF CLUB COVER AND RAKE

BACKGROUND OF THE INVENTION

1. Field of the invention

The invention relates to a golfers' tool combined with a club head cover and more particularly to the combination of a sand rake and a head cover.

2. Description of Prior Art

Many golfers choose to cover the heads of golf clubs that are not in use. Over the years many different designs have been chosen for head covers. Although head covers have been made from leather, knit fabrics, and the like, of most relevance to the present invention are those formed of a flexible, but stiff, material shaped so an elastic deformation of the cover allows the club head to be either inserted into or removed from the cover. Covers of this sort, because they protect the face of the club from impact damage, are often called "face covers". Exemplar among prior art patents in this area is U.S. Pat. No. 3,478,799 to Hoyt, Jr.

Notable among the prior patent art are several inventions combining a golf club head cover with a brush usable for cleaning dirt from grooves on the face of the club. In U.S. Pat. No. 5,050,655, Borenstein teaches a golf club head cover comprising two hinged pieces that snap together about the head of a club. One or both of Borenstein's two pieces have a brush fastened to an outer surface with bristles projecting outward of the portion of the cover that covers the toe of the club head. In U.S. Pat. No. 4,971,126, Borenstein teaches a head cover made of a semi-rigid, flexible plastic material having an opening or aperture into which the club head is inserted. In this patent Borenstein discloses a brush having bristles extending outward of that portion of the cover that covers the sole of the club head. Borenstein's bristles are necessarily small enough in diameter to fit into a groove on the face of a club, and therefore are sharp enough to create a risk to the golfer of having his or her hand painfully scratched when reaching for a club and accidentally contacting the bristles. Moreover, neither of the face-cleaning brushes taught by Borenstein is suitable for raking sand in a sand trap because of the close spacing and small size of the bristles, which would compact the sand.

Although many golf courses try to keep a rake at or near each sand trap, these are sometimes misplaced. Hence, many golfers carry sand rakes with them on their golf cart and use such rakes to re-surface the sand in a trap after hitting a ball out of the trap. A golfer who carries a sand rake must thus carry both the rake and his or her sand wedge into the trap.

SUMMARY OF THE INVENTION

The invention provides a single apparatus serving as both a golf club head cover and as the head of a sand rake.

It is an object of the invention to provide a golf club head cover that also functions as a sand rake head.

It is an additional object of the invention to provide a sand rake having a portion functioning as a golf club head cover.

It is yet an additional object of the invention to provide a sand rake comprising, in combination, a rake head, a golf club head cover and a golf club, where the rake head is attached to, or integrally formed with, the head cover.

It is a further object of the invention to provide a sand rake head pivotally disposed on a golf club head cover.

DESCRIPTION OF THE PREFERRED EMBODIMENT

Figure 1:
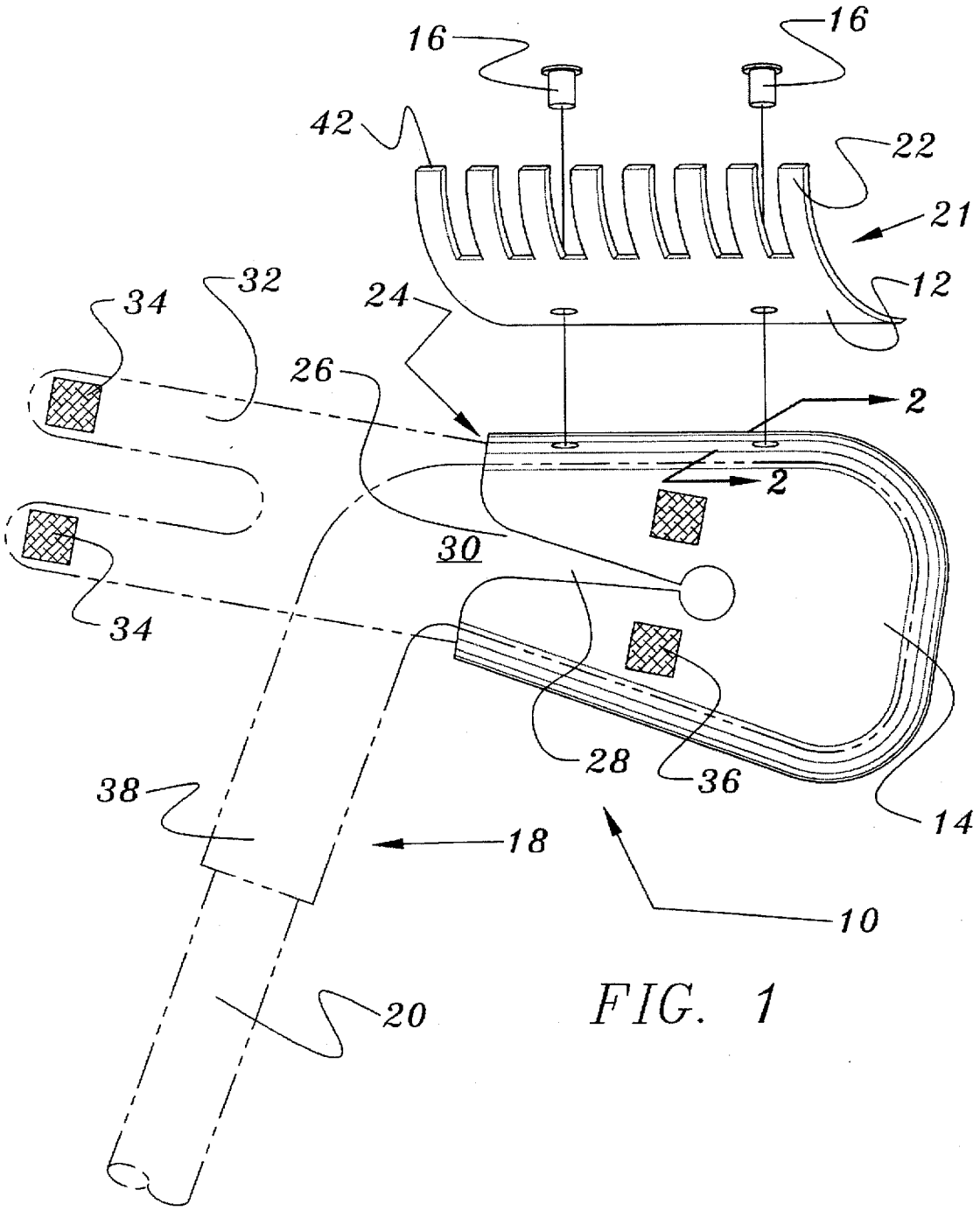
FIG. 1 is a partially exploded elevational view of a combined head cover and sand rake of the invention.
Figure 2:
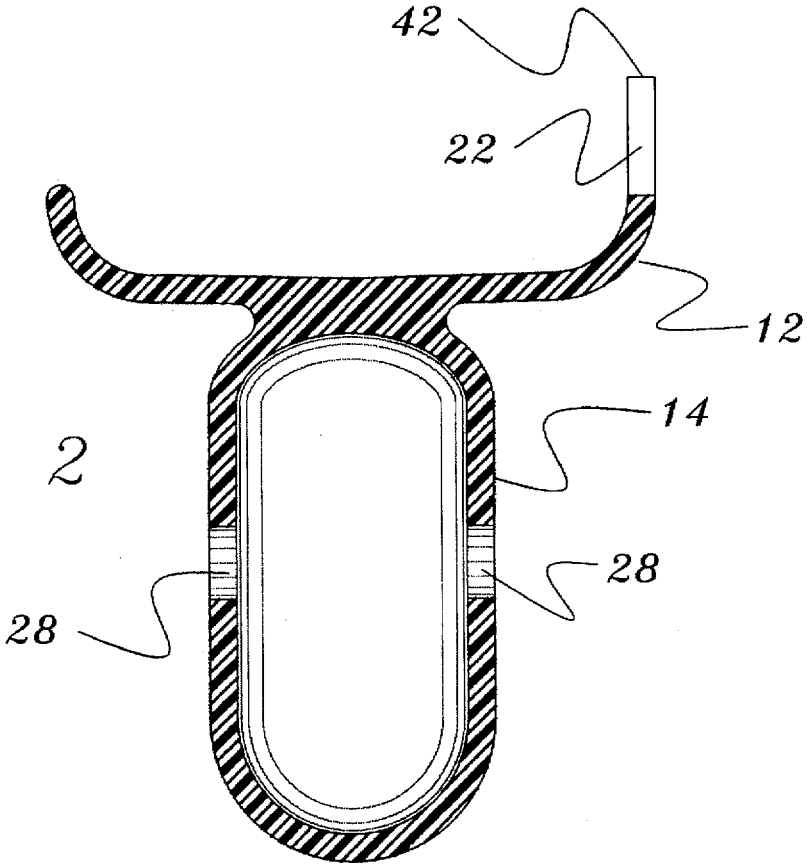
FIG. 2 is a cross-sectional view of the head cover and rake head portions of the apparatus of FIG. 1, the section taken as indicated with line 2—2 in FIG. 1.

A preferred embodiment of a sand-rake 10 of the invention is depicted in FIG. 1. The rake 10 comprises a rake head 12 attached to a golf club head cover 14 (e.g., by means of rivets 16 or other fasteners) having a golf club 18 inserted therein. This arrangement allows a golfer to dress the surface of sand in a sand trap by holding the shaft 20 of the club 18 and raking the sand with the teeth 22 of the rake head 12 to yield the ridged sand surface topology desired by golfers. Because it is expected that the primary use of the apparatus of the invention will be in raking sand in a sand trap, it is also expected that the club 18 employed will usually be a sand wedge, but it is noted that other clubs could be used for the same or similar raking purposes.

Figure 3:
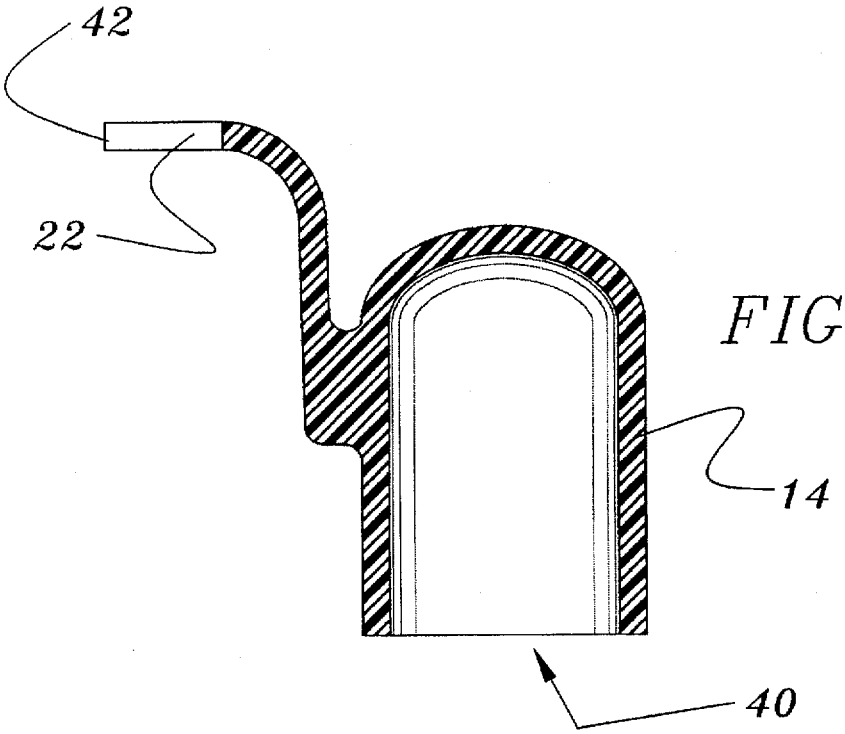
FIG. 3 is a cross-sectional view taken along a section corresponding to that used for FIG. 2 of an embodiment of the invention having the rake portion attached to the head cover portion in a different fashion.

The preferred head cover portion 14 is made from a resilient plastic material and has a pocket-like shape having an open end 24 into which the toe of the club head 26 may be inserted. A conventional set of laterally extending slits 28 adjacent the face 30 and the back surface of the club head 26 allow the cover podion 14 to be elastically deformed so that the club head 26 can be inserted into or withdrawn from the cover portion 14. It is noted that a variety of choices can be made for the shape, size and materials used for the cover portion 14. For example, if the cover podion 14 of the sand rake 10 tends to be pulled off the club head 26 by the raking operation, one embodiment of the invention provides suitable fastening means to hold it to the club head 26. These means, for example, could be a separately fastenable tab 32 (shown in dot-dash phantom in FIG. 1) with a known hook-type fastener 34 attached thereto, the hook type fastener 34 cooperating with a known loop-type fastener 36 to close the tab 32 about the hosel 38 of the club 18. Alternately, the cover podion 14 may be configured in a pocket-like shape having an aperture 40 into which the sole of the club head 26 may be inserted (e.g., as depicted in FIG. 3). A cover portion 14 of this sort, as is known in the art, may comprise spring-biased hubs, or an externally fastened tab 32 to retain the club head 26 within the cover portion 14.

A preferred rake head portion 12 comprises a single row 21 of tines or teeth 22 having tips or free ends 42 that are blunt or rounded. Sharp tines 22 provide no advantage in raking loose sand, and blunt or rounded teeth 22 are less likely to cause a golfer discomfort when he or she reaches into a golf bag and bumps his or her hand against the rake head 12. Hence, the tines 22 are preferably substantially wider than a groove in the face of a golf club 18. In a preferred embodiment the rake head portion 12 comprises a row 21 of tines 22, each of which is 2–4 mm wide with spaces of comparable width between them. It may be noted that the number of tines 22 may vary as a matter of convenience, and is expected to be larger if the club 18 has an oversize head 26.

Figure 6:
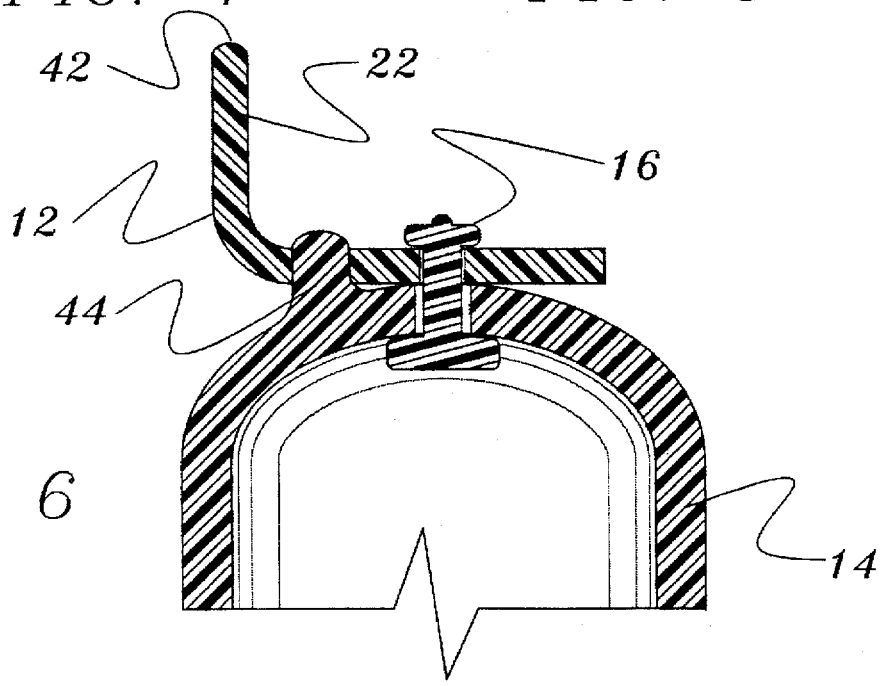
FIG. 6 is a cross-sectional view along the section indicated as 6—6 in FIG. 4.

The teeth 22 may be straight (e.g., as depicted in FIG. 6) or curved (as depicted in FIG. 1). The orientation of the teeth 22 is preferably selected so that when the rake 10 is in use the teeth 22 are disposed at an angular orientation intermediate that of the club face 30 and a line perpendicular to the axis of the club shaft 20.

Figure 4:
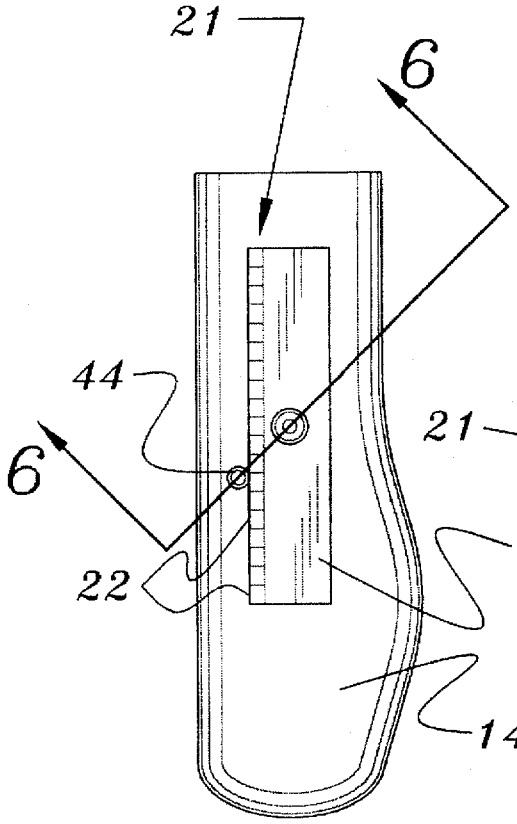
FIG. 4 is a bottom plan view of an embodiment of the invention having a swiveling rake, with the rake in one of two limiting rotational positions.
Figure 5:
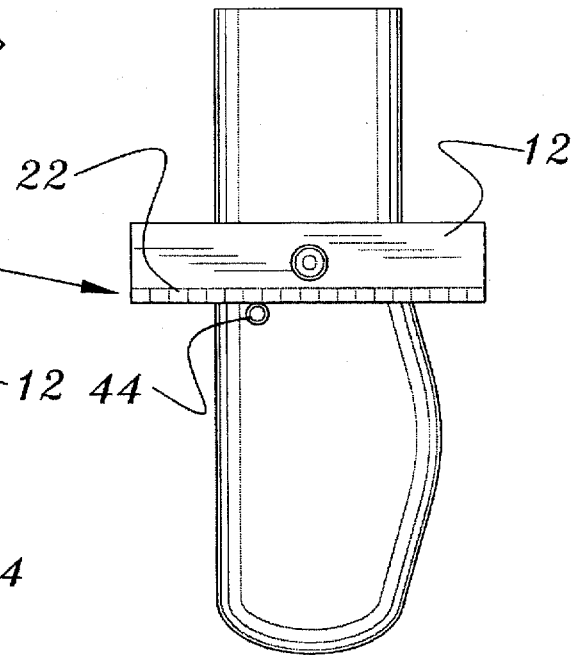
FIG. 5 is the same a FIG. 4, save that the rake is in the second of the two limiting positions.
Figure 7:
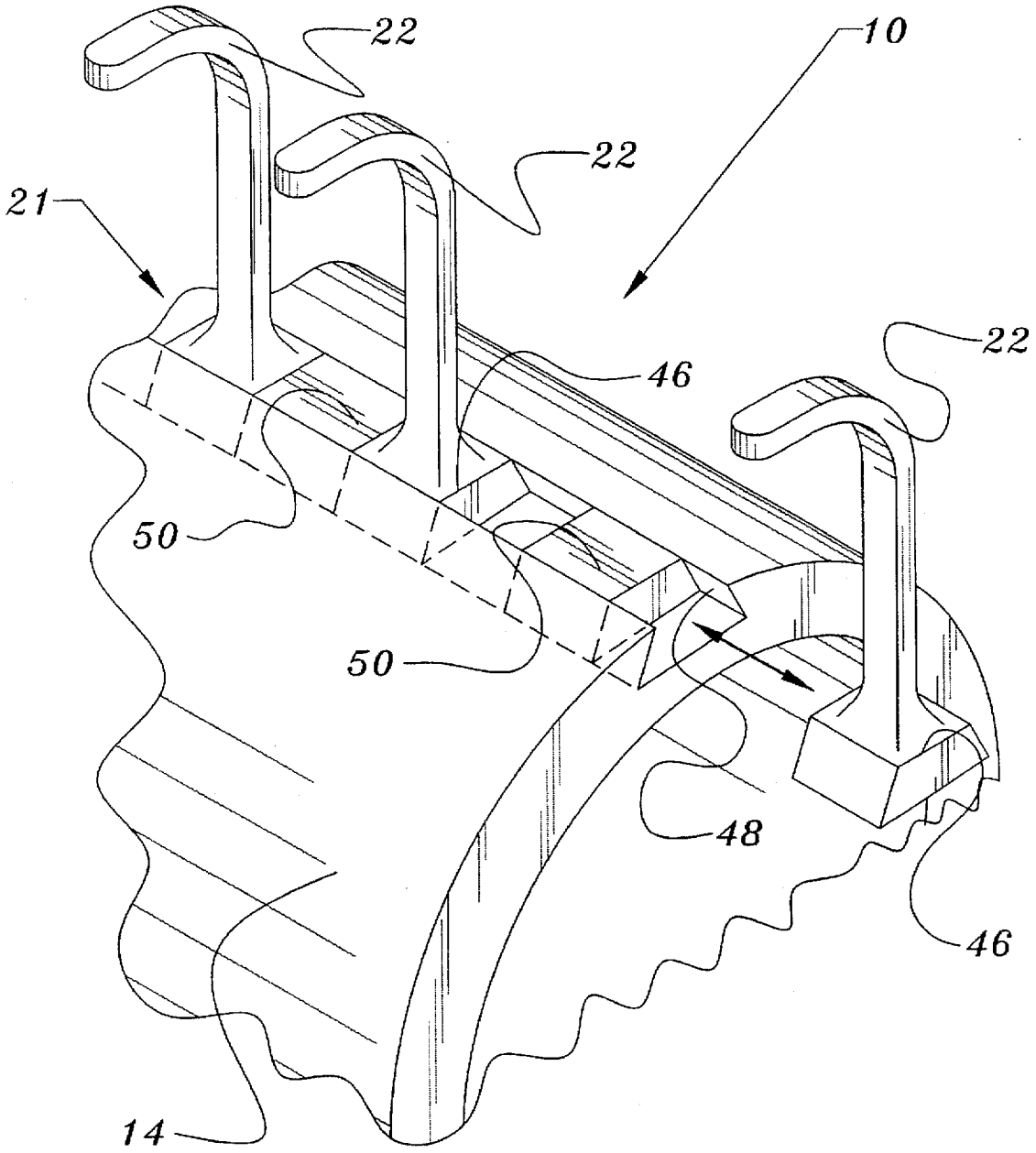
FIG. 7 is a cut-away elevational view of another embodiment of the invention.

The rake head portion 12 may be attached to the head cover portion 14 in a variety of ways. For example, the rake head portion 12 can be welded to, or integrally formed with the head cover portion 14 (e.g., as depicted in cross-section in FIG. 3). Alternately, if the rake head portion 12 is made of a different material than is used for the face cover portion 14, it can be fixedly attached with suitable fasteners 16 (e.g., as depicted in FIG. 1 ), or can be removably attached thereto (e.g., the tongue 46 and groove 48 arrangement depicted in FIG. 7). Alternately, the rake head portion 12 can be pivotally attached to the head cover portion 14 (e.g., as shown in FIGS. 4–6). In this latter configuration, the oscillatory movement of the rake head portion 12 may be limited by known means, such as the provision of a stop or detent 44.

It may also be noted that the rake head portion 12 may be attached to the head cover portion 14 at various locations. For example, the rake head portion 12 may be attached to that part of the head cover portion 14 adjacent the sole of the club 18 (e.g., as depicted in FIGS. 1, 2 and 4–6). Alternately, the rake head portion 12 may be attached to the head cover portion 14 so as to be adjacent either the face or the back of a club 18 inserted into the head cover portion 14 (e.g., as depicted in FIG. 3).

Because the distribution of grain sizes in the sand used in a sand trap varies from place to place (e.g., from a uniform, fine-grain sand to a mixture comprising bits of gravel), the optimal size and spacing of the teeth 22 on a sand rake 10 will also vary. One embodiment of the invention, depicted in FIG. 7, allows the user to adapt the rake 10 to local conditions. In this embodiment the row 21 of teeth 22 may comprise a plurality of individual teeth 22, each of which is separately attached to the face cover portion 14 by sliding a dovetailed base portion 46 on the tooth 22 into a cooperating dovetailed groove 48. The size and spacing of the teeth 22 may thus be changed by removing teeth 22 of one size and shape and replacing the removed teeth 22 with other teeth 22 having a different size and shape. Additionally, one or more toothless spacer members 50 may be inserted into the groove 48 intermediate ones of the teeth 22 in order to adjust the spacing between teeth 22 to a desired value.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

I claim:

1. A combination head cover and rake head for use with a golf club, the combination head cover and rake head comprising:

a toothed rake head portion comprising a plurality of teeth, each of the teeth having a predetermined width substantially greater than a width of a groove in a face of a head of the golf club, each of the teeth spaced apart from an adjacent one of the teeth by a distance substantially equal to the predetermined width; and a head cover portion made of a semi-rigid, flexible material, the head cover portion comprising an aperture, the cover portion shaped to receive the head;

wherein the head cover portion comprises a second groove and wherein each of the teeth comprises a base portion cooperating with the second groove for insertion thereinto.

2. A golfer's sand rake comprising:

a golf club comprising a shaft and a head comprising a face having a groove formed therein;

a head cover portion made of a semi-rigid, flexible material, the head cover portion comprising an aperture, the head cover portion receiving the head therein; and a toothed rake head portion comprising a plurality of teeth arranged in a row, each of the teeth having a predetermined width substantially greater than a width of the groove, each of the teeth spaced apart from an adjacent one of the teeth by a distance substantially equal to the predetermined width, the toothed take head portion attached to the head cover portion, the rake-head portion not extending laterally outward beyond the head of the club.

* * * * *